US008800678B2

(12) United States Patent
Klayh et al.

(10) Patent No.: US 8,800,678 B2
(45) Date of Patent: Aug. 12, 2014

(54) OIL LUBRICANT

(76) Inventors: Keith Donald Norman Klayh, North Bay (CA); William Culhane, North Bay (CA)

( * ) Notice: Subject to any disclaimer, the term of this patent is extended or adjusted under 35 U.S.C. 154(b) by 241 days.

(21) Appl. No.: 12/998,783

(22) PCT Filed: Nov. 27, 2009

(86) PCT No.: PCT/CA2009/001724

§ 371 (c)(1),
(2), (4) Date: Jun. 1, 2011

(87) PCT Pub. No.: WO2010/063099

PCT Pub. Date: Jun. 10, 2010

(65) Prior Publication Data

US 2011/0226498 A1 Sep. 22, 2011

Related U.S. Application Data

(60) Provisional application No. 61/193,443, filed on Dec. 1, 2008.

(51) Int. Cl.

| | |
|---|---|
| ***E21B 1/30*** | (2006.01) |
| ***C10M 111/04*** | (2006.01) |
| ***C10M 169/04*** | (2006.01) |

(52) U.S. Cl.

CPC ..... *C10M 169/041* (2013.01); *C10M 2207/30* (2013.01); *C10N 2230/06* (2013.01); *C10M 2209/1105* (2013.01); *C10M 111/04* (2013.01); *C10M 2205/0285* (2013.01); *C10M 2209/11* (2013.01); *C10N 2220/022* (2013.01); *C10N 2240/06* (2013.01); *C10N 2230/36* (2013.01); *C10N 2230/02* (2013.01); *C10M 2207/301* (2013.01)

USPC ..... 173/1; 173/2

(58) Field of Classification Search

USPC ..... 173/1, 3, 46, 77; 184/6.26, 55.1, 55.2; 508/463

See application file for complete search history.

(56) References Cited

U.S. PATENT DOCUMENTS

| | | | | |
|---|---|---|---|---|
| 2,918,429 | A | 12/1959 | Gililland et al. | |
| 2,918,430 | A * | 12/1959 | Massin et al. | 508/153 |
| 3,040,835 | A | 10/1960 | Ahnert | |
| 5,427,203 | A | 6/1995 | Anspach, Jr. et al. | |
| 6,070,698 | A * | 6/2000 | Wells | 184/55.2 |
| 6,399,550 | B1 | 6/2002 | Zehler | |
| 7,312,185 | B2 * | 12/2007 | Willey et al. | 508/165 |
| 2003/0158055 | A1 * | 8/2003 | Deckman et al. | 508/571 |
| 2003/0207775 | A1 * | 11/2003 | Sullivan et al. | 508/463 |
| 2007/0000807 | A1 * | 1/2007 | Wu et al. | 208/18 |

FOREIGN PATENT DOCUMENTS

| | | | |
|---|---|---|---|
| CA | 2655040 | A1 | 12/2007 |
| CA | 2655040 | A1 | 12/2007 |

OTHER PUBLICATIONS

Barber, Anthony. Pneumatic Handbook. New York: Elsevier Science Ltd., 1997, 8th Ed. ISBN I-85617-249-X, pp. 113-120 and 269-278.

* cited by examiner

*Primary Examiner* — Andrew M Tecco
*Assistant Examiner* — Nathaniel Chukwurah

(57) ABSTRACT

An air tool or air motor lubricant for adding to compressed air, and the method of operating air tools with the lubricant, in which the lubricant comprises a mixture of a polyalphaolefin or polyalphaolefin blend having a viscosity in the range of 2 to 3000 cSt and a high molecular weight complex ester in a ratio of 1.3:1 to 20:1 of the polyalphaolefin or polyalphaolefin blend to the high molecular weight complex ester. The lubricant comprises about 58 to 90 vol % polyalphaolefin or polyalphaolefin blend and about 10 to 42 vol % high molecular weight complex ester. The mixture of polyalphaolefin or polyalphaolefin blend and high molecular weight complex ester is added in an amount in the air of about 0.2 to 0.6 ppm effective to generate a lubricant airborne mist concentration in exhaust air of 0.2 ppm or less.

15 Claims, No Drawings

OIL LUBRICANT

RELATED APPLICATION DATA

This application is the national stage entry of International Patent Application No. PCT/CA2009/001724, filed on Nov. 27, 2009, which itself claims priority to U.S. Provisional Patent Application No. 61/193,443, filed on Dec. 1, 2008. All claims of priority to these applications are hereby made.

BACKGROUND OF THE INVENTION (i) Field of the Invention

The present invention relates to a lubricant for an air line oiler or lubricator for use with various types of pneumatic tools and motors, and more particularly, relates to an improved lubricant for use with pneumatic rock drills and the like.

(ii) Description of the Related Art

Air line lubricators are well known for supplying compressed air with a lubricant or oil so that pneumatic tools and motors can be continuously lubricated to minimize wear during use. Pneumatic rock drills, for example, are particularly prone to wear due to their use in environments having significant amounts of water and other contaminants present in the compressed air supply, as well as due to the high load and torque conditions imposed on the tool in certain rock formations and in bolting. It is therefore important to maintain an effective oil film on internal tool surfaces.

U.S. Pat. No. 3,040,835 issued Jun. 26, 1962 discloses a typical air line lubricator for supplying compressed air with a lubricant or oil for lubricating pneumatic rock drills.

Surgical tools often are driven by compressed air to avoid electrical sparks in the combustible environment of an operating room due to the presence of oxygen and anesthetics. The pneumatic motors of the surgical tools are lubricated by an oiler that feeds a predetermined quantity of a lubricant into the compressed air driving the pneumatic motors. A quantity of lubricating oil is exhausted from the pneumatic tool into the operating room and it is desirable to use an effective lubricant which is non-toxic and does not produce an exhaust mist in an operating room environment.

U.S. Pat. No. 5,427,203 issued Jun. 27, 1995 discloses an air line lubricator system for introducing a lubricant to compressed air which drives a pneumatic motor of a surgical tool used in an operating room and for recovering and recycling lubricant to minimize discharge of lubricant into the operating room.

Petroleum greases also are known for lubrication of pneumatic tools because of their higher initial viscosity than petroleum oils and their attribute of better adherence to metal surfaces. However, there is some question as to the overall effectiveness of grease as opposed to oils under certain conditions, especially cold ambient temperatures as well as in overhead drilling and bolting conditions. Although they have a higher initial viscosity than petroleum based rock drill oils, and therefore may help to reduce fogging, greases have a viscosity index of only 94 typically, which means that they thin out somewhat more rapidly under high temperature operating conditions, than do conventional petroleum rock drill oils. Therefore, their high viscosity in the lubricator restricts the amount of grease entering the air supply, which is desirable for reducing oil fog, but their tendency to lose viscosity under high heat conditions could result in the tool being starved of enough lubricant under certain conditions to meet the lubrication requirements of the tool, potentially resulting in premature wear. This would be predictable if the grease is exposed to high temperature operating conditions within the tool, causing the grease to lose viscosity and to be exhausted more rapidly by the high velocity air passing through the tool than replenishment by the cooler, thicker grease within the lubricator. In other words, the grease is exiting the tool faster than it is entering it. As well as the aforementioned problems, when the tool lubed with grease is stopped, and cools down, the grease becomes so thick that it clogs the air chambers and the drill won't restart, or starts in a sluggish manner.

It is a principal object of the present invention to provide a lubricating oil for pneumatic tools which provides improved lubrication with very little oil fog generation.

Petroleum based rock drill oils produce significant amounts of oil mist in the exhaust air, which tends to coat the tool, drill rods and the drill operator with oil, making the equipment slippery and obstructing the operator's vision and breathing.

It is another object to provide a cost-effective lubricating oil which is non-toxic in environments with very limited ventilation, such as underground mining areas and in operating rooms, and which produces a minimum of oil mist.

SUMMARY OF THE INVENTION

These and other objects of the invention will become apparent from the following description.

We have found surprisingly that low to high viscosity polyalphaolefins (PAO) having viscosity in the range of 2 to 3000 centistokes (cSt), preferably 2 to 10 cSt, and most preferably 9 or 10 cSt, (grade rated at 100° C.) such as are sold under the trademark SpectraSyn™, or Synfluid™, along with a PAO compatible polymerized low molecular weight, shear stable, complex ester such as is sold under the trademarks SYNESTER® GY-56 by Lubrizol Corporation or PRIOLUBE™ sold by Croda Lubricants, with the addition of an anti-wear/extreme pressure, corrosion and rust and oxidation package such as KX 1236M (KX1255) sold by King Industries, have been found to provide unexpectedly improved lubrication and wear performance for pneumatic tools and air motors over a wide range of operating temperatures and with low emission of airborne mist.

More particularly, a said blend of polyalphaolefin, along with a polymerized ester of the invention, as well as an anti-wear, extreme pressure (EP), corrosion and rust and oxidation (R/O) package, used as a lubricating oil for pneumatic tools and air motors, provides unique advantages, as follows:

- improved lubrication with extended service life of the air tools and motors.
- Dramatic reduction in the generation of oil mists or "fog". Oil mist contamination is at or below American Conference of Governmental Industrial Hygienists (ACGIH) recommended new threshold limit value (TLV) standard of 0.2 ppm.
- Dramatic reduction in the quantity of oil required to effectively lubricate tools—between ⅓ and ½ of the quantity typically required based on a petroleum based lubricant.
- Improved environmental appeal as the lubricant is inherently biodegradable and is used in greatly reduced quantities
- Improved protection against water contamination due to the polarity of the tenacious film provided by the lubricant, which provides an unbroken barrier between the water and the tool.
- Improved worker health and safety, as the lubricant is composed of ingredients that are generally recognized as safe.

In its broad aspect, the method of the invention relates to the operation of pneumatic tools and air motors and comprises adding to the compressed air a lubricant comprising a mixture of a polyalphaolefin or polyalphaolefin blend having a viscosity in the range of 2 to 3000 cSt and a low molecular weight complex ester in a ratio of 1.3:1 to 20:1 of the polyalphaolefin to the low molecular weight complex ester combined with an antiwear/EP/Corrosion and RO package in an amount of lubricant effective to lubricate the air tool.

Preferably, the method of the invention relates to pneumatic rock drills and the like mining and industrial pneumatic equipment and comprises adding said lubricant to compressed air driving the pneumatic equipment in an amount of about 0.2 to 0.6 ppm effective to lubricate the pneumatic equipment, in a ratio of the polyalphaolefin to the polymerized ester in a ratio of 1.3:1 to 20:1, preferably in a ratio of 1.3:1 to 10:1.

More preferably, the lubricant comprises about 58 to 90 vol % polyalphaolefin and about 10 to 42 vol % low molecular weight complex ester.

An anti-wear, extreme pressure, corrosion, rust and oxidation additive preferably is added to the lubricant in an amount of about 1.5 to 2 vol % of the total composition.

DESCRIPTION OF THE PREFERRED EMBODIMENT

Typical mechanisms for introduction of a predetermined quantity of a lubricating oil into compressed air by the use of air line lubricators is disclosed in aforementioned U.S. Pat. Nos. 3,040,835 and 5,427,203. Conventional lubricating oils are hydrocarbon products from petroleum oils which are discharged by carry-over with exhaust air from the tool into the ambient air system. This tends to cause fogging in the general vicinity of the tool exhaust, which in turn causes discomfort and potential respiratory concerns to operators in the vicinity. A typical hydrocarbon oil lubricant used for lubricating pneumatic rock drills, for example, is sold by Petro Canada in Canada under the name ARDEE 150™.

Although the description will proceed with reference to pneumatic rock drills, namely jacklegs and stopers, it will be understood that the method of the invention has utility with pneumatic equipment such as long hole drills, jumbos, jack hammers, breakers, chipping hammers and bolters and with industrial tools such as drills, orbital sanders, ratchets, hammers, bolters, chisels, socket drives, cutters and the like, and with surgical tools and with air motors, and air cylinders.

Although it is understood that we are not bound by hypothetical considerations, it is believed the PAOs are specially designed chemicals that are uniquely made from alpha olefins. These stable molecules are produced by:

- Steam cracking hydrocarbons to produce ultra high-purity ethylene
- Ethylene oligomerization to develop 1-decene and 1-dodecene
- Decene or dodecene oligomerization to form a mixture of dimers, trimers, tetramers and higher oligomers The PAO's used in the invention are hydrogenated olefin oligomers manufactured by the catalytic polymerization of linear alphaolefins having viscosities of about 2 to about 3000 centistokes (cSt), preferably about 2 to 10 cSt, and more preferably 9 to 10 cSt, identified as for example SpectraSyn™ 9 or 10, or Synfluid™ 8 or 9. The PAOs are used in combination with esters derived from various alcohols and of various viscosities which may be achieved through polymerization and/or hydrogenation having the characteristics of SYNESTER® GY-56 manufactured by Lubrizol Corporation, or PRIOLUBE™, manufactured by Croda Uniqema. Coupling agents may be used to ensure the long term stability of the lubricant.

Although low viscosity PAOs in the range of 2 to 10 cSt are preferred, the combination of a low viscosity PAO such as 10 cSt with higher viscosity PAOs such as PAO 100 cSt or higher are operative as a blend. However, the blends of low and higher viscosity PAOs have been found to negatively impact the stability of the lubricant, when blended with the low molecular weight ester, compared to the stability of the formula made with a single low viscosity PAOs of 10 cSt and less. PAO 10 is the preferred low viscosity polyalphaolefin because, in addition to its stability, it is used at a higher ratio in the formulation than the other low viscosity PAOs, resulting in the most economical and stable formulation.

The addition of anti-wear, extreme pressure, corrosion, rust and oxidation inhibitors, such as produced by King Industries of Norwalk, Conn. and sold under the product name KX 1236M, also named KX1255, in an amount of about 1.5 to 2 vol % of the total lubricant composition, has been found to aid anti-wear, extreme pressure and anti-wear, corrosion and rust and oxidation performance of the lubricant composition.

Table 1 following shows formulations for Exxon Mobil PAO products and for Chevron Phillips PAO products to achieve various product viscosities as referred to by "PT" designations at 40° C. It will be understood that PAO designations used herein are grade rated at 100° C. but that finished oils designated PT are rated at the standard commercial temperature of 40° C. Accordingly, by way of example, PAO 10 having a viscosity of 10 cSt at 100° C. would have a viscosity of 66 cSt at 40° C.

TABLE 1

| | | |
|---|---|---|
| PT 75 | | |
| 89% PAO 9 Chevron<br>9.3% GY-56<br>1.7% KX 1236M King Industries | OR | 85% PAO 8 EXXON<br>or Chevron<br>13.3% GY-56<br>1.7% KX 1236M |
| PT 100 | | |
| 85% PAO 10 EXXON<br>23.3% GY-56<br>1.7% KX 1236M | OR | 80% PAO 9 Chevron<br>18.3% GY-56<br>1.7% KX 1236M |
| PT 125 | | |
| 79% PAO 10 Exxon<br>19.3% GY-56<br>1.7% KX 1236M | OR | 74% PAO 9 Chevron<br>24.3% GY-56<br>1.7% KX 1236M |
| PT 150 | | |
| 73.3% PAO 10 Exxon<br>25% GY-56<br>1.7% KX 1236M | OR | 68% PAO 9 Chevron<br>30.3% GY-56<br>1.7% KX 1236M |
| PT 175 | | |
| 69% PAO 10 Exxon<br>29.3% GY-56<br>1.7% KX 1236M | OR | 65% PAO 9 Chevron<br>33.3% GY-56<br>1.7% KX 1236M |
| PT 200 | | |
| 66.6% PAO 10 Exxon<br>31.7% GY-56<br>1.7% KX 1236M | OR | 61.3% PAO 9 Chevron<br>37% GY-56<br>KX 1236M |
| PT 220 | | |
| 63% PAO 10 Exxon<br>35.3% GY-56<br>1.7% KX 1236M | OR | 59% PAO 9 Chevron<br>39.3% GY-56<br>1.7% KX 1236M |
| PT270 | | |
| 58% PAO 10 Exxon<br>40.3% GY-56<br>1.7% KX 1236M (KX1255) | OR | 55.9% PAO 9 Chevron<br>42.4% GY-56<br>1.7% KX1236M (KX1255) |

Conventional petroleum based lubricating oils have a threshold limit value, for airborne particulate, determined as a guideline by the American Conference of Governmental Industrial Hygenists (ACGIH) for recommended safe levels of hazardous materials in the workplace, of 5.0 parts per million (ppm). However, for 2009 the ACGIH has recommended that the threshold limit value for oil mists be reduced to 0.2 ppm. It has been found that, due to the use of reduced injection rates and due to the tenacious cohesiveness of the lubricant compositions of the present invention, air quality measurements have been recorded at or less than 0.2 ppm in the workplace.

Applicants have found that the addition of 0.6 litre of applicants' lubricant to rock drills consuming about 4750 litres per minute (175 cfm) for an eight-hour shift provided 0.262 ppm lubricant oil in the compressed feed air for the eight hours for a high viscosity PT 270 oil. A lower viscosity PT 75 oil consumed 0.6 litre of the oil for a four-hour shift providing 0.524 ppm of lubricant oil in the compressed air feed for four hours. Almost none of the oil at the lower about 0.2 ppm or at the higher about 0.55 ppm became airborne.

Petroleum based rock drill oils and greases are not biodegradable and must be remediated or recovered if spilled or aspirated onto the ground. The present composition is completely biodegradable and does not pose any threat to aggregate surfaces upon which it is aspirated.

Lubricants made from vegetable oils are well known. Tests conducted on oils derived from castor oil and canola oil indicated good lubrication but the oils have a number of issues that make them unsuitable for rock drill oils. For example, vegetable oils have poor low temperature properties, in that they thicken excessively, and can even become solid at temperatures encountered when compressed air is decompressed, or during cold weather operation. Vegetable oils are oxidatively unstable, and when they are exposed to air they tend to form varnishes that can harden to the point of seizing the tool. They are also hydrolytically unstable, and can form sticky, gooey deposits when combined and agitated with condensation often found in compressed air. Castor oil is a known irritant, and although it is useful in closed systems, it can cause worker discomfort when aspirated into the work environment.

The lubricant base stocks of the present invention having viscosities ranging from about 7 to 3000 cSt at 40° C., preferably 2 to 100 cSt, and more preferably about 9 or 10 cSt, are competitive in cost/use compared to petroleum based materials, resist fogging, when combined with the appropriate ester, are stable at elevated temperatures, have very little odor and have excellent oxidative stability. The synthetic polyalphaolefin (PAO) of the invention is produced by, but not limited to, Exxon Mobil Corporation and sold under the trade-mark SpectraSyn™, or by Chevron Corporation and sold under the trade-mark Synfluid™. The polyalphaolefin is fortified with a low molecular weight, complex, i.e. polymerized ester, preferably, but not limited to Lubrizol GY-56™, manufactured by Lubrizol. Polymerized esters manufactured by Croda Uniqema, and other manufacturers, can also be used, but may be limited based on their compatibility with PAO's, as well as their shear stability. Lubrizol GY-56™ in combination with PAO-10, for example, in a ratio of PAO to low molecular weight complex ester in the range of about 1.5:1 to about 20:1, preferably in a ratio of about 1.5:1 to 9:1, has been found to provide excellent lubricating protection. Tests conducted by the manufacturers have shown the PAOs and the esters to be non toxic.

Petroleum based oils are non polar in nature. Lubricant manufacturers must rely on additives to ensure that the oils adhere to metal surfaces. However, metal to metal motion creates a "squeegee" effect which tends to displace petroleum oil. Oil flow must be adequate to ensure that the oil film is constantly replenished. The absence of a consistent petroleum oil film could eventually result in tool failure. Petroleum rock drill oils sometimes are formulated with an emulsifier and, as water from the compressed air lines enters the lubricant, the emulsifiers are designed to mix the oil with the water to maintain a water-in-oil emulsion so as to avoid oil washout by the water, in which case the tool would not be protected. However, when there is a lot of condensation present in the air lines, the emulsifier tends to dilute the oil to a lower viscosity, resulting in less viscous lubricating film that is less effective than in its original form and the lubricant may become too thin to protect the tool. The tool life as a result may diminish, unless the operator compensates by increasing oil flow to the tool, which typically results in fogging. Additionally, some mine waters are corrosive, emphasizing the need for a tenacious lubricating film between the air/water and the tool surfaces.

The composition of the present invention, on the other hand, contains a polar molecular structure in the form of hydroxyl (—OH) molecules which impart to the fluid a negative charge. Ferrous metals are positively charged elements and the net result is that the composition is attracted to ferrous metals, forming a uniform lubricating film across the entire surface of the metal with which it comes in contact. This film is extremely tenacious, i.e. very difficult to displace, and is very durable. Therefore, as long as minute amounts of the lubricant pass over the metal surface, even without the constancy demanded by petroleum based products, proper lubrication will be assured. In one test, the lubricator containing applicants' lubricant was intentionally shut down completely. After 10+ minutes of operation, the tool began to warm up and eventually began to stall. The tool was allowed to cool, the lubricator was reopened allowing applicants' lubricant to flow through the lines, and the tool began to function normally, without any apparent damage.

Attempting this with petroleum based product could result in a damaged tool that might need to be rebuilt.

Several tests of the lubricant of the invention were conducted, as follows:

Initial Bench Testing:

A new Boart Longyear S-250™ jackleg was fitted with a Boart Longyear football style lubricator, which was then connected to an Ingersoll Rand™ 185 compressor. The compressor was operated at 185 cfm @110 psi. The manufacturer's specifications dictate an operating condition of 175 cfm @90 psi, so the drill was inadvertently operated at a "red line" conditions. The lubricator was filled with a 200 grade of applicant's lubricant, and the drill was mounted on a base without the drill rod steel installed. Also, there was no water supplied to the tool. This practice is not recommended, as the drill body absorbs all of the heat and impact energy that would normally be transferred into the drill steel rod. As a result the drill operates at a very high temperature, and the energy from the hammer piston is transferred to internal drill components, typically causing drill damage or total failure. The actual temperature of the drill housing was measured at 93° C., which was too hot to handle. Under actual operating conditions, when an air operated hammer type of tool becomes very hot, it can cause a "dieseling" effect with the compression chamber, in which case the lubricant actually ignites or oxidizes, losing its lubricating properties. This typically results in a shortened service life or damage to the tool. Also, free-wheeling experienced during this type of test (excess RPM—no load) can cause unusual wear.

The drill was operated for two hours under these conditions, and was repeatedly started and stopped during the test, to determine if the drill would seize up. The drill restarted without fail, and without a loss of RPM's due to heat induced shrinking of clearance tolerances.

Upon completion of the bench test, the drill was disassembled, and inspected by a Bout Longyear technician, commonly referred to as a "drill doctor". The expected result was damage to the tool. However, the drill doctor reported no unusual wear symptoms or unacceptable discoloration of the metal surfaces due to excessive internal heat build-up.

Site Test #1—Liberty Mine, Timmins, Ontario

The first field test of applicants' lubricant was undertaken at Liberty Mine near Timmins, Ontario, Canada on a pair of pneumatic rock drills, i.e. a jackleg and a stoper. The drills were used to create a vent raise to surface, involving overhead drilling and blasting of a siliceous rock ceiling. When the ceiling has been blasted down and mucked out (cleared), the miners come back into the area, scale the blasted surface, and stand on the blasted rock to drill the next set of rounds. There was virtually no ventilation, providing worst possible operating conditions in which to test. Using only 35 to 40% of the amount of PT 150 rock drill fluid of the present invention compared to Petro Canada's ARDEE 150™ rock drill oil consumption, the operator drilled successfully and without any fog. He also reported being much cleaner than was typical when drilling with conventional petroleum based rock drill oil.

When operating with petroleum oil based rock drill oil, the drill would frequently experience operating problems due to water in the compressed air freezing upon exit of the drill's compression chamber. The operator had to stop the tool and chip the ice away from the exhaust port. This did not happen after switching to the appropriate grade of applicants' lubricant.

The petroleum oil also made the operators' faces, safety glasses and oilers coated with an oily film by shift's end. After switching to applicants' lubricant PT 150, the operators were oil free.

The conventional petroleum oils made the drill and steel drill rods slippery, and it was often necessary to stop work to rub gloves with rock drill fines to get a grip. There were no slippery deposits on the tool using applicants' lubricant, primarily because the amount of oil that was being injected had been reduced to the point wherein oily deposits on the tools had been virtually eliminated, and also due to the fact that the applicant's lubricant did not create a fog which tends to settle on the tool and objects around it, making them slippery.

While using ARDEE 150™, large amounts of water in the compressed air would cause the water to freeze up upon exiting the muffler. In order to keep the drill running, the driller was forced to break off the ice with his wrench, or increase the quantity of oil injected, which caused the ice to be flushed away. However, this also resulted in fogging, tool bleeding and discomfort to the drill operator.

Using the applicant's 100 cSt grade oil, the oil remained at a sufficiently low viscosity to flow freely, and ice particles were constantly sloughed off in the compressed air stream. There was no loss of productivity due to tool freeze up.

Trial #2—Goldcorp Hoyle Pond, Timmins, Ontario

The customer previously was using Exxon/Esso Arox EP 150™ rock drill oil. Average product consumption was 10 litres per shift (average 2 shifts per day). The mine operation is a narrow vein gold mine, and the equipment on which the test was conducted was a Boart Longyear BCI 2™ longhole drill, on level 1020A. The heading was approximately 8' square. Ventilation was completely shut down to prevent blowback upon the operator.

The applicants' PT 150 lubricant was added to the tool, and the lubricator setting was not adjusted, in order to ensure that the applicants' lubricant was allowed to completely coat all working surfaces of the tool. After the completion of the shift, the operator reported that the tool was running smoothly and that there was little to no fog generated. The next morning the lubricator was adjusted considerably downwards, i.e. the quantity of lubricant injected was reduced, and the tool continued working. The operator immediately noticed that there was virtually no fog being generated and there was no odor from the lubricant. He also mentioned that the rods were much drier, and that they were subsequently much easier to handle, as slippage was eliminated. Lubricant consumption was estimated to be ½ of the amount typically used when drilling with Exxon Arox EP 150™. Subsequently, the lubricator was further adjusted downward to about ⅓ of its normal setting with good results.

Trial #3—Iamgold Mouska Mine—Rouyn, Quebec

Mouska Mine was a participant in the CanMet Narrow Vein Mining project, and had previously tried, unsuccessfully, to address fogging issues. The applicants' trial was conducted on level 13 of Mouska Mine. Product being used before was Esso Arox EP 150. When applicants arrived at the mine site, the drilling rig, equipped with 3 Joy AL 67 drills, was emitting enough oil fog to make it difficult to see beyond 4 or 5 feet within the drift. There was limited ventilation in the drift, and the oil mist was hanging in the air for approximately 8 minutes. The Joy rig operates on approximately 600 cfm compressed air @90 psi. Lubricant consumption was typically 4.5 litres of conventional petroleum rock drill oil per shift. The lubricator was a Boart™ 9 litre capacity model. At the beginning of applicants' lubricant test, most of the Arox EP150™ lubricant was emptied from the lubricator, while about 2 litres remained. The applicants' lubricant, PT 175, was added to the lubricator, and without adjustments, the drill rig was restarted. Within 25 minutes (the time that it takes to clear the lines) the drill rig was producing considerably less fog. Within one hour, the air in the drift was almost completely clear, in spite of the fact that there was a mix of PT 175 and Arox EP150™.

In order to determine the effectiveness of the low molecular weight complex ester in the lubricant composition, a series of tests were conducted at another site with compressed air at 95 psig and 175 CFM with an ambient temperature of 124° F. from the compressor using a S-250™ Boart Longyear stoper. The stoper S-250 was secured to a wooden pallet, and operated without cooling water or a steel drilling rod. All the heat generated by the uncooled operation of the stoper was retained within the tool, which resulted in an abnormal heat build-up. Tests were run for seven hours without wear damage to the stoper, other than minor wear to the ratchet pawls, which suffered from irregular ratcheting due to operating without a load. All other components of the tool were within new tool specs.

A blend of PAO 10 (about 66 vol %), PAO 100 (about 22 vol %), GY-56 (about 10 vol %), and KX 1236M (KX1255) additive (about 1.7 vol %) having a viscosity of 197 cSt at 40° C. was supplied to the S-250 stoper drill for the seven hour test, and resulted in no visible fog. The tool ran smoothly and at a relatively low temperature (134° F.), with minimal lubricant leaking from the tool and very little odour.

A comparative test under the same conditions with the PAO 10 and PAO 100 blend and KX 1236 M additive, but with no GY-56 ester, resulted in generation of fog, as well as heat buildup in the tool, eventual bleeding of lubricant from the tool and gradual choking of tool due to heat build-up and loss of clearance of the tool parts.

A PAO 10/100 blend as described above with 5 vol % GY-56, 10 vol % Cargill Agri-Pure™ 458 ester and 1.7 vol % KX 1236M (KX1255) additive, was tested under comparable conditions, and resulted in slight fog, thinning and loss of viscosity of the lubricant, and excessive lubricant bleeding and heat build-up within the tool. It is believed the presence of the Cargill Agri-Pure 458 ester was detrimental to the lubricant blend by weakening the polymeric bonds in the GY-56 ester, causing it to break down and lose its viscosity with the consequence of the generation of fog.

Trial #4—JS Redpath, North Bay, Ontario

A test was conducted at JS Redpath Raise Bore Facility in North Bay, Ontario using an S-250 stoper operating with compressed air at 98 psig and 39.4° F. with Petro Canada Ardee™ 100 rock drill oil lubricant. The temperature of the S-250 stoper rose to 192° F. during the 25 minute test. Some fog was noted during the tool operation with bleeding and spraying of lubricant around the tool area. A strong petroleum odour was emitted from the tool.

The S-250 stoper was then tested with applicants' PT 120 lubricant under the same operating conditions with no visible fog for the entire 25 minute test. The maximum stoper temperature was 129° F., implying that the lubricating film from the applicant's PT120 was reducing friction within the tool. No spraying of the lubricant, or odour from the lubricant was observed.

Trial #5—Campbell Mine, Red Lake, Ontario

A comparative test was conducted at Goldcorp Campbell Mine in Red Lake, Ontario on air motors in jackleg and stopper drills used in the driving of raises involving difficult vertical overhead drilling. The test lasted seven months and compared the use of applicants' PT 150 lubricant with prior art Esso AROX EP 150. Applicants' lubricant was used in 525 feet of vertical timbered raise versus 750 feet of vertical untimbered raise using the prior art product. The one drill using applicants' lubricant consumed one-third the quantity of the prior art lubricant for a comparable drill with no down time due to lubricant failure. The eight jackleg and stopper drills using the prior art lubricant suffered motor seizure and scorched pistons, notwithstanding the lubricators supplying the oil were continually adjusted, and required down time for rebuilding. The drill using applicants' lubricant generated fog at a scale of 2 (in a scale range of 1 to 10 with 1 being best and 10 worst) whereas the drills using the prior art lubricant was rated at a scale of 8. As a result, the drill using applicants' lubricant was relatively dry and easy to handle whereas the drills using the prior art lubricant were oily and slippery and more difficult and less safe to handle.

The American Conference of Governmental Industrial Hygenists has, in the past, recommended a TLV of 5 parts per million (ppm) for rock drill oils. New proposed changes to TLV levels by the ACGIH, based on their 2005 conference, are now recommending a reduction in airborne oil mists to 0.2 ppm. Actual field tests of applicants' lubricant have proven that the goal of a reduction of airborne oil mists to 0.2 ppm is achievable.

Petroleum based rock drill oil and grease are not biodegradable and must be remediated or recovered if spilled. Applicants' lubricant is completely biodegradable and does not pose any environmental threats to surface cover upon which it is aspirated.

Oxidative stability is gauged by the iodine value of an oil. The higher the iodine value, the greater the tendency of the oil to oxidize or polymerize to form gummy and varnish like deposits that can hamper of even stall the operation of an air operated tool. The ester of choice in the formulation of applicants' lubricant has a low iodine value (<2) and has demonstrated a very low tendency to form varnishes.

Viscosity index is a petroleum industry term. It is a lubricating oil quality indicator, an arbitrary measure for the change of kinematic viscosity with temperature. The viscosity of liquids decreases as temperature increases. The viscosity of a lubricant is closely related to its ability to reduce friction. Generally, it is desirable to have the thinnest liquid/oil which maintains an unbroken lubricating film between the moving surfaces, preventing metal to metal contact. If the lubricant is too thick, it will require a lot of energy to activate the tool, due to increased drag resistance. Conversely, if the lubricant's viscosity is too low, the surfaces will contact each other, and this metal to metal contact will cause subsequent damage. The lower the viscosity index the more dramatically the oil's viscosity will drop as temperature increases. The higher the viscosity index, the less dramatically an oil's viscosity changes with temperature increase.

As stated above, the Viscosity Index highlights how a lubricant's viscosity changes with variations in temperature. Many lubricant applications require the lubricant to perform across a wide range of conditions: lubricants must reduce not produce too much drag between tool components when they are started from cold, and must provide adequate separation between metal surfaces when tool is running hot under high load and torque conditions (>100 ° C.). The best oils (with the highest viscosity index) will not vary excessively in viscosity over a broad temperature range and therefore will perform well throughout the entire temperature spectrum typically encountered in underground mining operations.

The viscosity index of the 150 cSt lubricant of the present invention, and of the prior art tested at 100° C. are as follows, the applicants' Pneuma-Tool 150 having the highest viscosity index (VI):

Pneuma-Tool PT 150—VI 150

Esso Arox EP™ 150—VI 102

Petro Canada Ardee™ 150—VI 92

The more temperature decreases, the more dramatically the viscosity of a low viscosity index rock drill oil will increase. This is extremely important when dealing with an air tool, since as compressed air exits the tool, it decompresses and loses latent heat from the air. That means that the air entering the tool is always warmer than the air exiting the tool. The net result of this loss of latent heat is a tendency for moisture in the compressed air to freeze as it exits the tool, especially when high concentrations of moisture are present in the compressed air. Freezing of air as it exits the tool can cause an ice build-up that can make the tool perform sluggishly, or even stall. Once this happens, the operator must stop work and clear the frozen ice by chipping it away with a tool. At worst, the operator must wait until the tool thaws on its own before recommencing work. If a lubricant becomes too viscous as temperature drops, it can restrict air flow throughout exhaust ports, and this restriction provides ideal conditions for airborne moisture to freeze in the tool. The Applicants' lubricant has a relatively high viscosity index, and tends to maintain a fluid liquid state even under very cold conditions. It is also been demonstrated that it is important to select a lower lubricant viscosity as conditions become colder. The field test conducted at Liberty Mines showed that, even though ice was forming in the air tool due to cold temperatures and a high concentration of moisture in the compressed air, the ice was perpetually sloughed out of the tool, along the slippery fluid surface of the applicants' lubricant. In other words, although ice formed, the lubricant remained at a sufficiently low viscosity to ensure that it flowed and moved the ice out of the tool.

The Four Ball Wear Test determines a lubricant's anti-wear properties under boundary lubrication (metal to metal contact). Three steel balls are clamped together to form a cradle upon which a fourth ball rotates on a vertical axis. The balls are immersed in the oil sample at a specified speed, temperature and load. At the end of a specified test time, the average diameter of the wear scars on the three lower balls is measured.

Pneuma-Tool was compared against Petro Canada Ardee 150™ and Esso Arox EP 150™

Wear test were conducted under the following conditions:

1800 RPM/40° C./20 Kg. Load.

Wear Scar Results:

Esso Arox EP 150™ 0.31 mm

Petro Canada Ardee 150™ 0.42mm*

* Based on Petro Canada's techdata Publication IM-7817E (09.08)

Pneuma-Tool™ PT 150—0.28 mm

A more severe test was conducted based on the following conditions:

1800 RPM/75° C./40 Kg. load

Only two lubricants were subjected to this test, and as the viscosities are not the same a direct comparison cannot be made, but inferences can be drawn based on the wide performance spread.

Esso Arox Ep 150™ wear scar—0.60 mm

Pneuma-Tool PT 175 wear scar—0.30 mm

Table 2 below shows a summary of comparisons between applicants' Pneuma-Tool 150 and various rock drill oils and greases, with fogging, tool life, odor, consumption, washout and operational costs rated on a relative basis, with designation "1" being the best and designation "4" the worst.

TABLE 2

| Product | Pneuma-Tool ™ | ARDEE 150 ™ Rock Drill Oil | Esso/Exxon Arox EP 150 ™ | VULTREX EP000 ™ Grease |
|---|---|---|---|---|
| V. Index | 150 | 92 | 100 | 94 |
| Fogging | 1 | 3 | 3 | 2 |
| Wear Scar | 1 | 4 | 2 | 3 |
| Odor | 1 | 3 | 4 | 2 |
| Consumption | 1 | 4 | 3 | 2 |
| Washout | 1 | 3 | 4 | 2 |
| Oper. Costs* | 1 | 3 | 4 | 2 |

*Includes operational gains from enhanced visibility, reduced slip hazards, reduced handling logistics, and other environmental considerations.

The present invention provides a number of important advantages compared to conventional rock tool lubricating oils.

A significant Reduction in the generation of oil mists or fog has been attained. This reduction is based upon two factors of (1) the polar attraction of the lubricant to metal surfaces and (2) the cohesive tendency of the polymeric molecules to adhere to each other and to form long, stringy filaments rather than to break apart under air pressure and velocity. A reduction in the quantity of lubricant required to provide an effective lubricating film is due to (a) the presence of hydroxyl groups in the oil that adhere tightly and uniformly to the metal surface and are not easily removed by mechanical action and (b) the shear stability of the lubricant that is provided by the selection of low molecular weight shear stable polymerized basestocks that have been found to provide a uniform, thick film over metal surfaces that do not deteriorate under load, shear and heat. Improved worker satisfaction, health and safety is provided due to (a) the benign nature (low order of health impact) of the fluids comprising the invention, (b) the low odor of the fluids and (c) the minute amount of lubricant mist that is generated during operation, resulting in airborne mist concentrations at or below 0.2 ppm., which has a positive impact on respiratory health, and which improves the hygiene conditions for workers, based on reduced slip hazards.

Economy of use is provided, in spite of the high raw material costs of the fluid components, due to (a) the fact that the tenacious lubricating film is not easily displaced and stays in place, (b) the structure of the base fluid molecules resists compressive forces (c) the fluid resists atomization and is attracted in a polar fashion to metal, it is able to perform its function as a lubricant instead of suffering loss due to extraction by the compressed air, and (d) the lubricant is highly oxidatively stable and resists breakdown in the presence of heat and pressure more than three times longer than conventional rock drill oils. The net result of this is a reduced consumption rate between ⅓ and ½ of the typical amount of petroleum oil that does the job it was intended for. An additional benefit is an reduced environmental impact, due to the fact that (a) the fluid is inherently biodegradable and (b) less oil is required to do the same job as petroleum oils, so potential contamination is reduced.

It will be understood that other embodiments and examples of the invention will be readily apparent to a person skilled in the art, the scope and purview of the invention being defined in the appended claims.

The invention claimed is:

1. A method of lubricating an air tool, such that during operation of the air tool, airborne lubricant exhaust mist is reduced or eliminated, the method comprising:

(a) adding lubricant to a compressed air feed in an amount of 0.2 ppm-0.6 ppm, said amount being effective to lubricate an air tool, said lubricant comprising:

between 58 vol % and 90 vol % of a polyalphaolefin or polyalphaolefin blend having a viscosity between 2 cSt and 3,000 cSt; and between 10 vol % and 42 vol % of a complex ester comprising polymeric molecules with a cohesive tendency to adhere to each other and to form elongate filaments when subjected to shear stresses; and (b) supplying said compressed air feed, to which said lubricant is added, to a compressed air feed input region of said air tool for driving said air tool; and (c) operating said air tool; said air tool, during operation, exhausting said compressed air feed as exhaust air from an exhaust region of said air tool; said exhaust air including lubricant mist, measurable in ambient air, into which said lubricant is carried by the compressed air exhausted from the air tool, in an amount comprising 0.2 ppm or less of lubricant.

2. A method as claimed in claim 1 in which the lubricant additionally comprises 1.5 to 2 vol % of an anti-wear/extreme pressure, corrosion, and rust and oxidation additive.

3. A method as claimed in claim 2, in which the mixture effective to lubricate the air tool has a viscosity in the range of 65 to 300 cSt at 40° C.

4. A method according to claim 2 in which the lubricant comprises about 73.3 vol % of the polyalphaolefin or polyalphaolefin blend, about 25 vol % of the ester, and about 1.7 vol % of the anti-wear/extreme pressure, corrosion and rust and oxidation additive.

5. A method according to claim 2 in which the polyalphaolefin or polyalphaolefin blend has a viscosity of between 7 cSt and 3,000 cSt at 40° C.

6. A method according to claim 2 in which the viscosity of the polyalphaolefin or polyalphaolefin blend is between 2 cSt and 100 cSt at 40° C.

7. A method according to claim 6 in which the viscosity of the polyalphaolefin or polyalphaolefin blend is between 9 cSt and 10 cSt at 40° C.

8. A method according to claim 1 in which the complex ester has a polar molecular structure imparting to the lubricant a negative charge, wherein the lubricant is attracted to metal surfaces inside the air tool made of positively charged ferrous metal and forms a tenacious film on the metal surfaces.

9. A method of lubricating an air tool, such that during operation of the air tool, airborne lubricant exhaust mist is reduced or eliminated, the method comprising:

(a) adding lubricant to a compressed air feed in an amount effective to lubricate an air tool, said lubricant comprising:

between 58 vol % and 90 vol % of a polyalphaolefin or polyalphaolefin blend having a viscosity between 2 cSt and 3,000 cSt; and between 10 vol % and 42 vol % of a complex ester comprising polymeric molecules with a cohesive tendency to adhere to each other and to form elongate filaments when subjected to shear stresses; and (b) supplying said compressed air feed, to which said lubricant is added, to a compressed air feed input region of said air tool for driving said air tool;

(c) operating said air tool; said air tool, during operation, exhausting said compressed air feed as exhaust air from an exhaust region of said air tool;

said exhaust air including lubricant mist, measurable in ambient air, into which said lubricant is carried by the compressed air exhausted from the air tool, in an amount comprising 0.2 ppm or less of lubricant; and wherein the complex ester has a molecular structure imparting to the lubricant a charge, and wherein the lubricant is attracted to metal surfaces inside the air tool comprised of oppositely charged ferrous metal and forms a tenacious film on the metal surfaces.

10. A method according to claim 9 in which the lubricant is added to the compressed air in an amount in the air of 0.2 ppm-0.6 ppm.

11. A method as claimed in claim 9 in which the lubricant additionally comprises 1.5 to 2 vol % of an anti-wear/extreme pressure, corrosion, and rust and oxidation additive.

12. A method according to claim 11 in which the lubricant comprises about 73.3 vol % of the polyalphaolefin or polyalphaolefin blend, about 25 vol % of the ester, and about 1.7 vol % of the anti-wear/extreme pressure, corrosion and rust and oxidation additive.

13. A method according to claim 11 in which the polyalphaolefin or polyalphaolefin blend has a viscosity of between 7 cSt and 3,000 cSt at 40° C.

14. A method according to claim 11 in which the viscosity of the polyalphaolefin or polyalphaolefin blend is between 2 cSt and 100 cSt at 40° C.

15. A method according to claim 14 in which the viscosity of the polyalphaolefin or polyalphaolefin blend is between 9 cSt and 10 cSt at 40° C.

* * * * *